US005830299A

United States Patent [19]

Teixidor Casanovas et al.

[11] Patent Number: 5,830,299

[45] Date of Patent: Nov. 3, 1998

[54] METHOD FOR MANUFACTURING LOADING PLATFORMS WITH REPLACEABLE FEET, AND PLATFORM MANUFACTURED WITH SAID PROCEDURE

[75] Inventors: Jaime Teixidor Casanovas, Esparreguera; Leopoldo Amaya Mele, Granollers, both of Spain

[73] Assignee: Videcart, S.A., Ibiricu de Egues, Spain

[21] Appl. No.: 782,332

[22] Filed: Jan. 13, 1997

[30] Foreign Application Priority Data

Jan. 18, 1996 [ES] Spain ..... 9600106

[51] Int. Cl.[6] ..... B65D 19/26

[52] U.S. Cl. ..... 156/70; 156/292; 156/313; 108/53.3; 108/56.3

[58] Field of Search ..... 108/53.3, 56.3; 156/228, 313, 70, 292, 297, 306.6

[56] References Cited

U.S. PATENT DOCUMENTS 2,706,099 4/1955 Whalley ..... 108/53.3
3,685,463 8/1972 Francis ..... 108/56.3
3,804,032 4/1974 Baucom ..... 108/56.3

FOREIGN PATENT DOCUMENTS 9635620 11/1996 WIPO .

*Primary Examiner*—Michael W. Ball
*Assistant Examiner*—Michael A Tolin
*Attorney, Agent, or Firm*—Steinberg & Raskin, P.C.

[57] ABSTRACT

Over a work bench provided with cavities is deposited a first layer with holes which coincide with the cavities. Feet are then installed having respective peripheral lugs with an interruption that coincides with a notch in each hole. The feet are lodged partially within the cavities, being supported by lugs having a diameter greater than that of the holes. Over layer is then deposited a second layer, glued on both faces and having holes of a diameter corresponding to that of the lugs. Over layer a third layer is installed, fitted with holes equivalent to holes. The assembly is compressed in a press to obtain a platform with incorporated feet. Several platforms may be obtained by orderly placing their respective layers and intercalating the feet, in a manner that, during manufacture, said feet are inserted in the feet of the platform located immediately below.

19 Claims, 3 Drawing Sheets

FIG. 1
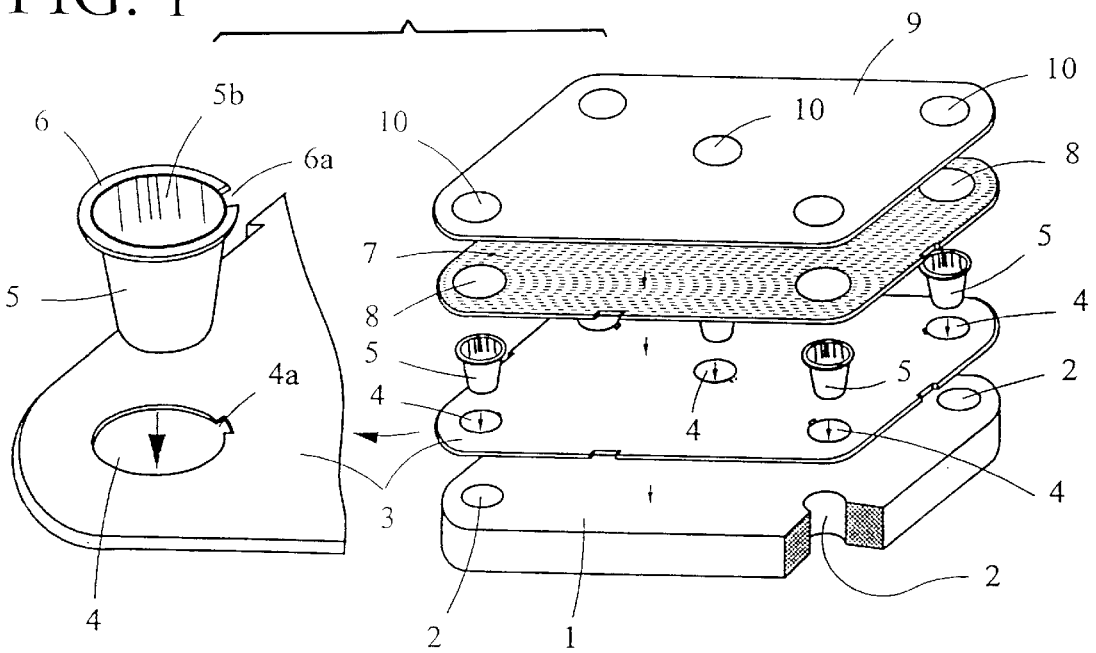
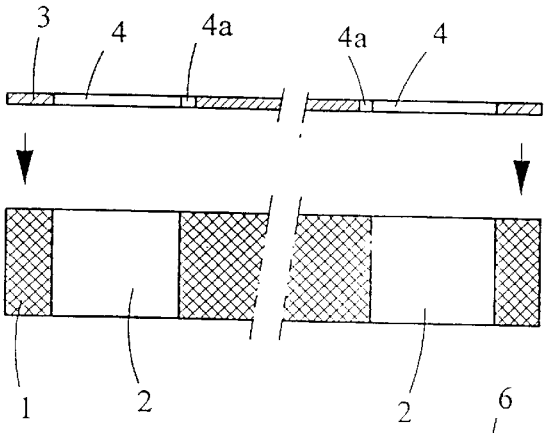
FIG. 2
FIG. 3
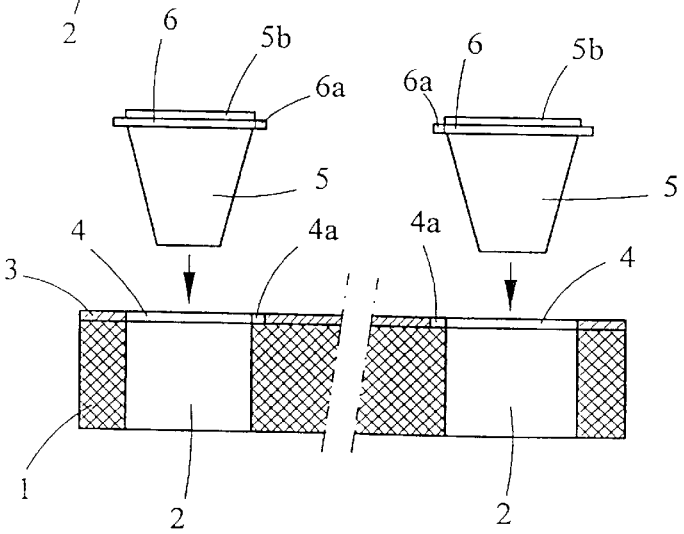

METHOD FOR MANUFACTURING LOADING PLATFORMS WITH REPLACEABLE FEET, AND PLATFORM MANUFACTURED WITH SAID PROCEDURE

This invention is related to a method for manufacturing loading platforms fitted with replaceable feet, although the method is likewise applicable to platforms fitted with fixed feet. This invention also relates to a platform manufactured with the use of said method.

BACKGROUND OF THE INVENTION

Patent No. ES-9500892 and addendum No. ES-9502178 (corresponding to patent PTC/ES96/00100) refer to a loading platform comprising one or more mutually bonded layers, advantageously made of cardboard and provided with evenly distributed openings, the openings in each layer corresponding to those of the remaining layers, on which layers feet are dismountably assembled, advantageously in the shape of a truncated cone and provided with a peripheral lug optionally fitted with an interruption having two opposite slanting edges in the form of a ramp to facilitate the insertion in and removal from an internal space located between two layers which configure the cardboard or similar material platform through a notch provided in the openings of the layer located on the platform of the lower side, through which the lug of the corresponding foot may be inserted or removed. The intermediate layer openings are larger than the openings in the upper and lower layers, although similar, thus enabling the formation of the above-mentioned internal space.

The manufacture of this type of platform has normally been implemented by the use artisan, low-profit methods, one of the main drawbacks consisting in the manual assembly of each platform foot after forming the mutually bonded layer structure, which results in excessive platform production times.

DESCRIPTION OF THE INVENTION

In order to overcome these drawbacks, a manufacturing method has been devised which is the object of the present application.

The method of the invention is characterized in that at least one first layer, the openings of which have already been die cut, is arranged on a work bench acting as a supporting block provided with cavities which coincide with the layer openings in the intended platform and having a width and depth that allows the insertion of the platform feet, the peripheral lugs of which act as an abutment means against the first layer upon inserting the feet. At least a second layer is then bonded onto the first layer, its openings coinciding with those of the first layer. The contour of the second layer openings is equivalent to that of the radial lugs in the feet. At least a third layer is then bonded onto the second layer, its openings coinciding with those of the previous layers. The openings of this third layer are equivalent to those of the first layer. The assembly is then placed under a press that consolidates the adhesion between the various layers, whereby the peripheral lugs in the feet end up at the height of an intermediate layer, e.g. the second layer, thus trapped between the adjacent upper and lower layers.

By virtue of the method of the invention, platforms can be produced with a considerably lower time consumption than that employed by artisan means. This is mainly due to the fact that the feet are installed immediately after placing the first layer on the work bench and before bonding the second layer over said first layer, thereby avoiding the subsequent manual installation of the feet.

It has foreseen the possibility of manufacture several piled-up platforms simultaneously. Thus, once the layers are overlaid and bonded, with the feet incorporated in the corresponding openings which constitute a platform, the same method is repeated by piling up successive groups of layers and their corresponding feet which are then inserted in the feet of the platform immediately below, the whole assembly then being submitted to the action of a press which consolidates the adhesion of the bonded layers in each platform.

In order to facilitate voluntary removal of the feet from the platform, after installing them in the course of the manufacturing process, the interruption in the peripheral lug is made to coincide with the notch in the corresponding opening in the lower layer.

The loading platform manufactured by the method of the invention is characterized in that each foot comprises on its side surface a plurality of reinforcement nerves formed as from said side surface.

According to a first preferred embodiment, the feet are elliptic in cross-section, with a plurality of undulations being provided which define the reinforcement nerves.

According to a second preferred embodiment, the feet are oblong in cross-section, said shape being defined by two semi-circumferences linked by two respective straight portions, with a plurality of undulations being provided which define the reinforcement nerves.

Advantageously, the feet comprise a radial lug with a U-shaped contour, the smaller side of the lug being bevelled and the opposite side of the lug being interrupted by a ramp formed on the end thereof. The bevelled smaller side of the lug makes easier the introduction of the foot.

BRIEF DESCRIPTION OF THE DRAWINGS

In order to better understand the description contained in this specification, drawings are attached which, merely by way of example, reflect a practical case of an embodiment of said method and platform.

In said drawings, FIG. 1 is a perspective view showing a work bench or supporting block and three separate layers designated in the description as the first, second and third layers, according to the order in which they are placed on the work bench; this same figure shows the platform feet located between the first and second layers; furthermore, this figure shows an enlarged detail of a corner of the first layer and a foot;

FIGS. 2–6 show longitudinal section views of subsequent platform manufacturing stages;

DESCRIPTION OF A PREFERRED EMBODIMENT

Figure 4:
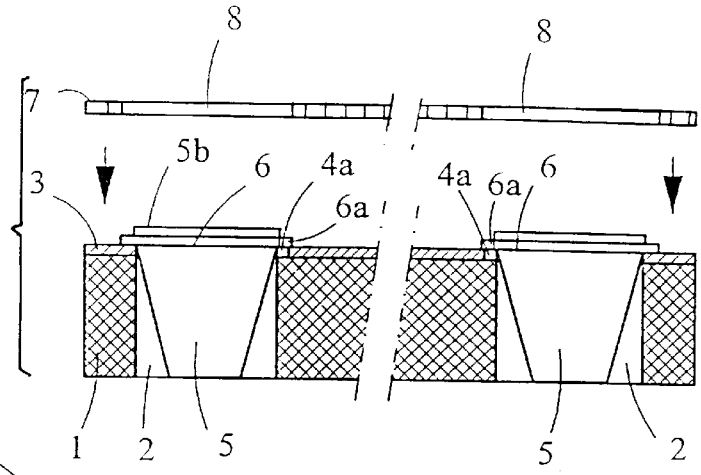

The manufacturing method of the loading platform fitted with replaceable feet consists—according to the example shown in the drawings—in the use of a work bench or supporting block 1 provided with several evenly distributed cavities 2, on which bench is deposited a first known layer 3 made of cardboard, "tablex" or some similar material having a some stiffness and provided with openings 4 of a diameter equivalent to that of the cavities 2 in bench 1, with which they are required to coincide. These openings 4 present respective notches 4*a,* the object of which is described further on. Advantageously, the lower side of layer 3 is impervious to water (FIGS. 2 and 3).

Truncated cone-shaped, hollow feet 5 are then inserted through the openings 4 in plate 3, in such a way that they lodge mainly within the cavities 2 in the bench 1. Said feet 5 are fitted with an open upper base 5*b* having an adjacent peripheral lug 6 with an interruption or notch 6*a,* the ends thereof forming ramps or bevels the original position of which coincides with that of notch 4*a*.

Thus, once the platform is obtained, the feet 5 are suitably positioned for removal at will, as described in patent PCT/ES/9600100.

Lug 6 has a diameter that is greater than that of opening 4, thereby providing a stop over layer 3 and limiting the insertion of foot 5 in cavity 2 (FIGS. 3 and 4).

The following stage of the method involves depositing a second layer 7, of a nature equal or similar to that of layer 3, both faces of which are covered with glue or adhesive. This second layer is provided with openings 8 of a diameter equivalent to that of the peripheral lug 6 of feet 5, the lug being thus surrounded by the corresponding opening 8. The upper base 5*b* in each foot projects slightly respect to layer 7 (FIGS. 4 and 5).

Figure 5:
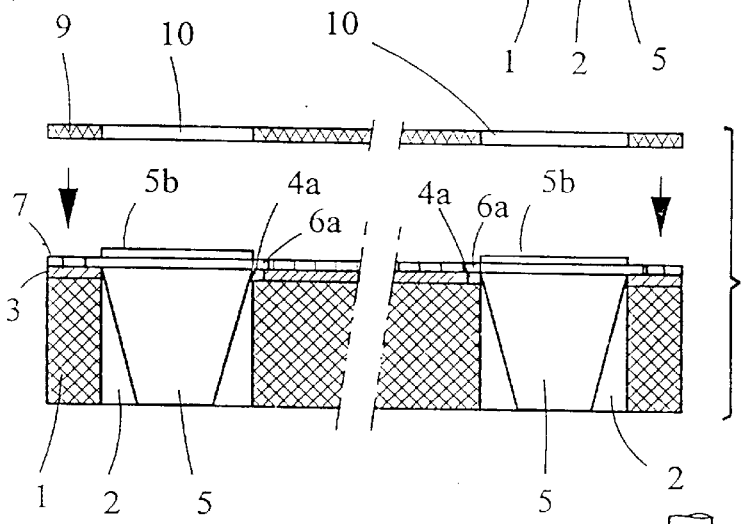
Figure 6:
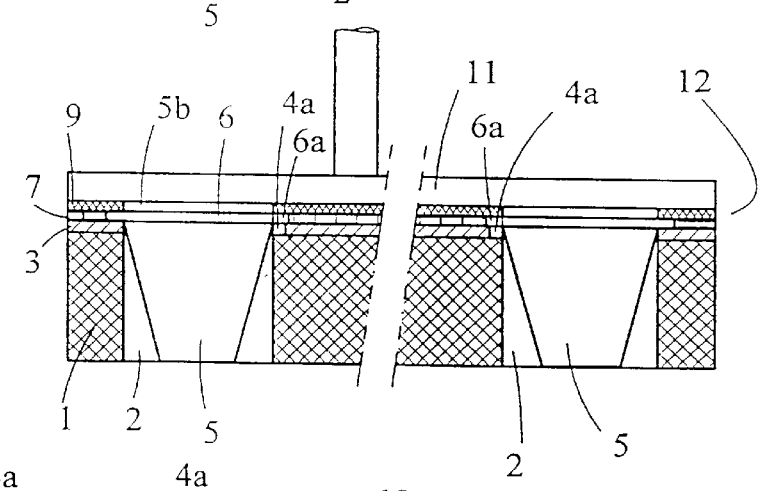
Figure 7:
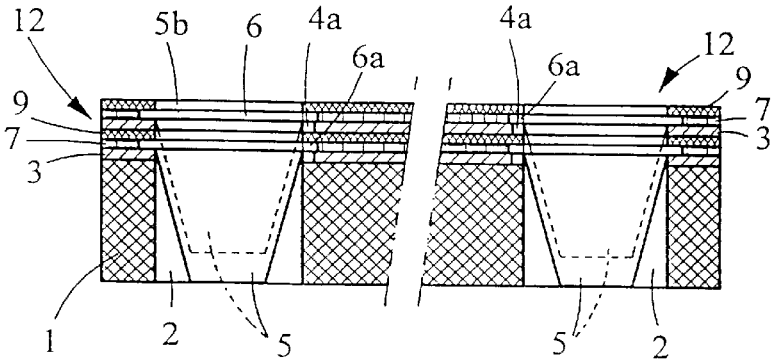
FIG. 7 is a view similar to the previous views, showing two platforms piled on the work bench.

Over layer 7 is deposited a third layer 9 that is equal or similar to the first layer 3, is fitted with openings 10 having the same diameter as that of openings 4—although devoid of a notch, its upper face being impervious to water—and has a contour that is equivalent to that of base 5*b* of feet 5, so that said base is flush or coplanar in respect to layer 9 (FIGS. 5 and 6). The loading platform manufacturing method ends with the pressing of the layer assembly 3, 7, 9 with a conventional press 11 (FIG. 6) designed to bond the layers to one another, the lugs 6 of feet 5 remaining trapped between plates 3, 9 and the feet being thus incorporated to the bonded layer assembly which constitutes a platform 12.

The number of layers forming each platform may vary; however, the manufacturing procedure is basically as described.

Using this same process, and by repeating the stages described, groups of platforms 12 can be manufactured by superimposing the layers in the described order and intercalating the feet 5 between corresponding layers, so that the feet in each layer are inserted in those of the lower layer, then proceeding to the final pressing of a group of platforms 12, the example illustrated in FIG. 2 of the drawings showing only two, although their number could be increased.

Figure 8:
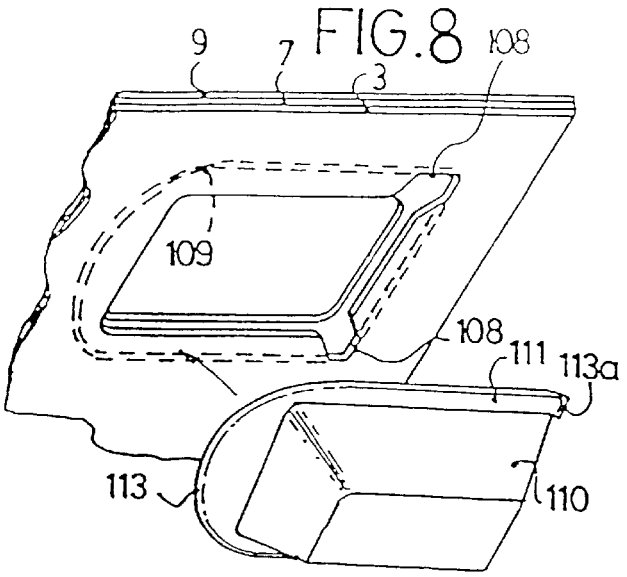
FIG. 8 is a perspective view of a first alternative embodiment of the feet, wherein the various holes in the layers forming the platforms are also shown.

FIG. 8 shows a first alternative embodiment of the feet 110, which is not object of the present invention. This embodiment is included in patent PCT/ES/9600100 and is described in this application to indicate that alternative feet exist other than those shown in FIGS. 1–7, which may be inserted in the holes in a different way, as explained in said patent, said insertion being made only when one of the feet has to be replaced, in view that, according to the method of the invention, feet 5, 110, 210, 310 are installed before bonding the second layer 7 onto the first layer 3.

The feet 110 are fitted with a radial lug 111 having a U-shaped contour which surrounds the two larger sides and one of the smaller sides in the foot of the upper base. The edge in the lug of the smaller side has a beveled edge 113 designed to facilitate the entry in space 109 of the notches 108. The lug is interrupted in its opposite side, its ends forming a ramp or skid 113*a* which facilitates removal of the lug in the event of having to replace the foot.

Figure 9:
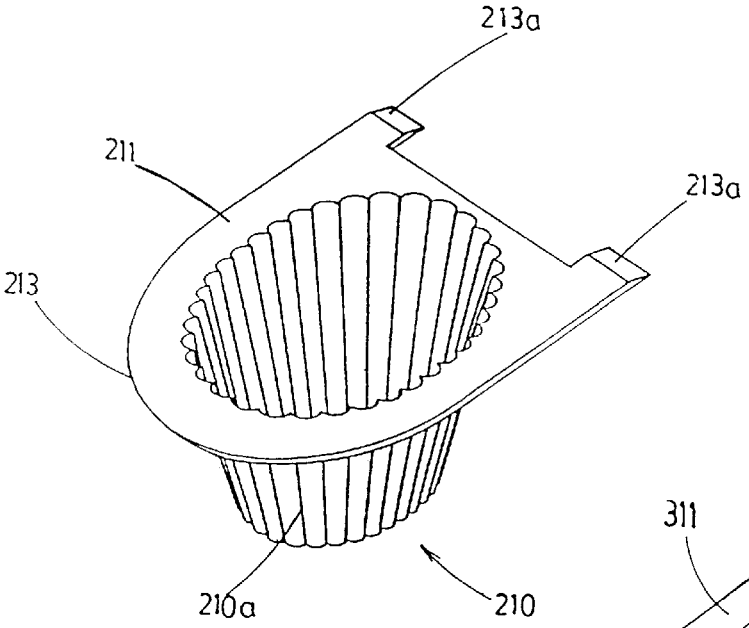
FIGS. 9 and 10 are perspective views of a second and third alternative embodiments of the feet.
Figure 10:
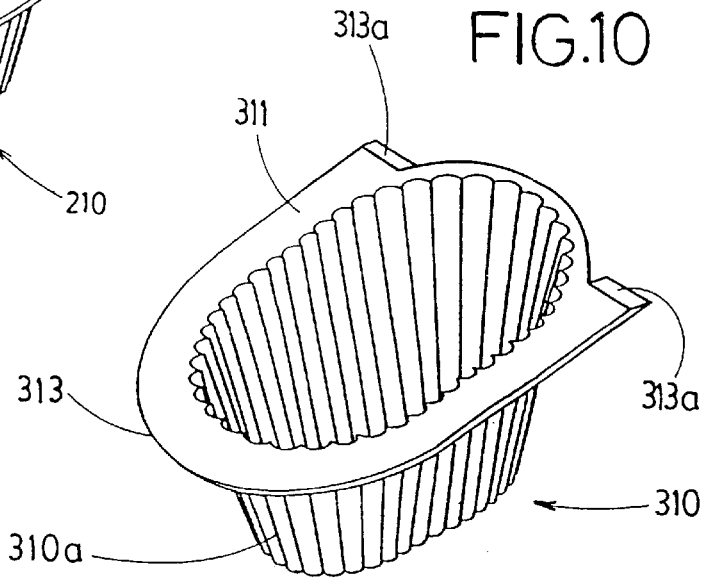

FIGS. 9 and 10 show alternative embodiments of feet 210, 310, their side surfaces comprising a plurality of reinforcement nerves 210*a,* 310*a* formed on said lateral surface. Said feet 210, 310 have an elliptic shape with a plurality of undulations which define the reinforcement nerves 210*a,* 310*a*.

Feet 210, 310 are fitted with a radial lug 211, 311 having a U-shaped contour which surrounds the two larger sides and one of the smaller sides in the foot's upper base. The edge in the lug of the smaller side is a beveled edge 213, 313, the lug being interrupted in its opposite side and its ends forming a ramp or skid 213*a,* 313*a* which facilitates removal of the lug in the event of having to replace the foot, as in the case of the feet previously described. The bevelled smaller side of the lug makes easier the introduction of the foot.

The system for inserting the feet 210, 310 in this second alternative embodiment is the same as that for feet 110 in the first alternative embodiment, as described in detail in patent PCT/ES/9600100.

The materials comprised in the various platform layers and the number of layers involved in each platform are independent from the essential object of the invention. The number and distribution of the platform feet may also be varied. Likewise, the method of the invention may be conducted in an automated manner, using layer supplying mechanisms for sequentially depositing the layers on the work bench 1 and for intercalating feet 5, 110, 210, 310 at the precise moment, namely before bonding the second layer 7 onto the first layer 3, ending with the final pressing of one or more layer groups.

We claim:

1. Method for manufacturing loading platforms fitted with replaceable feet and comprising one or more mutually bonded layers, each layer having evenly distributed openings, the openings in each layer coinciding with those of the remaining layers in which respective feet are dismountably incorporated, said feet being hollow and open on their upper face, the width of said feet decreases toward a lower floor supporting base, each foot being provided with a peripheral lug fitted with an interruption having two opposite slanting edges in the form of ramps designed to facilitate their insertion into and removal from an internal space located between two layers forming the platform through a notch provided in the openings of a lower layer located on the lower face of the platform, thereby enabling insertion and removal of the lug of the corresponding foot; the openings of an intermediate layer of the platform being larger than although similar to the openings of the lower and upper layers, thus allowing for the formation of the above mentioned internal space;

the method comprising the steps of:

placing a first layer with its corresponding openings already die cut on a work bench in the form of a supporting block which is fitted with cavities coinciding with the layer openings of the intended platform layers, said platform having a width and depth permitting the insertion of platform feet, the peripheral lug of said feet constituting a feet insertion stopping means by abutment against the first layer;

bonding a second layer onto the first layer, said openings in said second layer coinciding with those of the first layer; the second layer opening contour being equivalent to that of the radial lugs in said feet, said radial lugs on said feet having substantially the same thickness as said second layer;

bonding at least a third layer onto the second layer, said openings in said third layer coinciding with those of said first and second layers; the third layer openings being equivalent to those of the first layer; and pressing the assembly of said first, second and third layers and feet in order to consolidate adhesive between said first, second and third layers, the peripheral lugs in the feet thereby remaining at the height of said second layer, trapped between said first and third layers.

2. Method for manufacturing loading platforms fitted with replaceable feet, according to claim 1, characterized in that, once the layers are superimposed and bonded, the feet being incorporated in the corresponding openings which constitute a platform, the same procedure is repeated by piling up subsequent groups of layers with their corresponding feet inserted in the feet of the platform located immediately below, the group assembly being submitted to the action of a press that consolidates the bonding of each platform's bonded layers.

3. Method for manufacturing loading platforms fitted with replaceable feet, according to claims 1, characterized in that, upon placing the platform feet between the corresponding layers during the manufacturing process, the interruption of its peripheral lug is made to coincide with notch in opening corresponding to lower layer.

4. Loading platform manufactured by the method according to claim 1, characterized in that each foot comprises on its side surface a plurality of reinforcement nerves formed as from said side surface.

5. Loading platform according to claim 4, characterized in that the feet have an elliptical cross-sectional shape and have a plurality of undulations which define the reinforcement nerves.

6. Loading platform according to claim 4, characterized in that the feet have an oblong cross-sectional shape, said shape being defined by two semi-circumferences linked by respective straight portions, a plurality of undulations defining the reinforcement nerves.

7. Loading platform according to claim 4, characterized in that the feet comprise a radial lug having a U-shaped contour, the smaller side of the lug comprising a beveled edge, the lug being interrupted in its opposite side and its ends forming a ramp.

8. Method for manufacturing loading platforms fitted with replaceable feet, according to claim 2, characterized in that, upon placing the platform feet between the corresponding layers during the manufacturing process, the interruption of its peripheral lug is made to coincide with notch in opening corresponding to lower layer.

9. The method of claim 1, wherein said layers are made of cardboard.

10. Method for manufacturing a loading platform with removable feet, comprising the steps of:

placing a first layer of material having openings on a work bench having cavities coinciding with said openings, inserting feet into said openings in said first layer, each of said feet having a peripheral lug having two opposed slanting edges in the form of ramps defining an interruption therebetween, said feet being inserted into said openings until said lugs abut against said first layer, bonding a second layer of material having openings to said first layer, said openings in said second layer coinciding with said openings in said first layer and corresponding to the shape of said lugs, said lugs having substantially the same thickness as said second layer, bonding a third layer of material having openings to said second layer, said openings in said third layer coinciding with said openings in said second layer and corresponding to the shape of said openings in said first layer, and pressing the assembly of said first, second and third layers and feet to thereby form a platform whereby said lugs remain at the height of said second layer between said first and third layers, wherein said openings in said first layer of material are provided with notches to enable insertion and removal of said feet from spaces defined between said first and third layers.

11. The method of claim 10, wherein said first, second and third layers are made of cardboard.

12. The method of claim 10, further comprising the step of:

forming said first, second and third layers of material with uniformly distributed openings.

13. The method of claim 10, wherein said cavities in said work bench and said openings in said first layer of material are circular, further comprising the step of:

dimensioning said cavities in said work bench and said openings in said first layer of material to have a substantially equivalent diameter.

14. The method of claim 10, wherein said feet have a truncated, conical shape and are hollow such that said feet have an open upper base.

15. The method of claim 14, further comprising the step of:

positioning each of said lugs adjacent said open upper base of a respective one of said feet.

16. The method of claim 10, wherein said feet and said lugs are circular and said lugs have a diameter greater than a diameter of a respective one of said feet.

17. The method of claim 10, further comprising the step of:

applying adhesive to both faces of said second layer of material such that when pressed, said second layer adhesively bonds to said first and third layers.

18. The method of claim 10, wherein said feet are inserted into said openings in said first layer of material such that said interruption of said lugs coincides with said notch in a respective one of said openings in said first layer.

19. The method of claim 10, further comprising the step of:

after pressing the assembly of said first, second, third layers and said feet, forming another platform by placing a first layer of material having openings on the previously formed platform, and continuing with the insertion of feet into said openings, the bonding of second and third layers of material and pressing the assembly in order to form the another platform.

* * * * *